US005893619A

United States Patent [19]

Nachbaur

[11] Patent Number: 5,893,619

[45] Date of Patent: Apr. 13, 1999

[54] DRAWER SLIDE

[75] Inventor: Jürgen Nachbaur, Lustenau, Austria

[73] Assignee: Alfit Aktiengesellschaft, Götzis, Austria

[21] Appl. No.: 08/918,579

[22] Filed: Aug. 19, 1997

[30] Foreign Application Priority Data

Aug. 20, 1996 [AT] Austria ..... 1490/96

[51] Int. Cl.[6] ..... A47B 88/04

[52] U.S. Cl. ..... 312/334.44; 312/334.27; 312/334.41

[58] Field of Search ..... 312/334.41, 334.6, 312/334.31, 334.44, 334.27, 334.19, 334.18

[56] References Cited

U.S. PATENT DOCUMENTS

| | | | |
|---|---|---|---|
| 1,412,699 | 4/1922 | Manchester | 312/334.18 |
| 2,000,463 | 5/1935 | Browne | 312/334.27 X |
| 3,053,582 | 9/1962 | Wenger | 312/334.19 X |
| 4,387,942 | 6/1983 | Lense | 312/334.41 X |
| 4,420,197 | 12/1983 | Dreiling | 312/334.41 |
| 4,447,095 | 5/1984 | Fielding | 312/334.18 X |
| 4,824,158 | 4/1989 | Peters et al. | 312/334.19 X |

FOREIGN PATENT DOCUMENTS

| | | | |
|---|---|---|---|
| 000 648 | 2/1996 | Austria . | |
| 2432684 | 2/1980 | France | 312/334.7 |
| 82 31 409 | 3/1983 | Germany . | |
| 3400692 | 7/1984 | Germany | 312/334.18 |
| 94 13 108 | 2/1995 | Germany . | |

*Primary Examiner*—Peter R. Brown
*Assistant Examiner*—David E. Allred
*Attorney, Agent, or Firm*—Collard & Roe, P.C.

[57] ABSTRACT

A drawer slide comprising a guide rail (1) and a drawer rail (10), the rails engaging in each other, the guide rail having an upper guiding web (6), a lower guiding web (5) and a web (4) connecting the upper and lower guiding webs. The drawer rail has an upper rolling web (9) supported on a first track roller (8) in a front end portion of the guide rail and the drawer rail carries a second track roller (11) in a rear end portion thereof, the second track roller rolling between the upper guiding web and the lower guiding web of the guide rail. A device for preventing the drawer rail from being lifted off the guide rail comprises a marginal web (13) consisting of a bent edge portion of the upper rolling web of the drawer rail, and a supporting stop (14) disposed on the connecting web of the guide rail and overlapping the marginal web whereby the supporting stop is adapted to be engaged by the marginal web.

5 Claims, 2 Drawing Sheets

DRAWER SLIDE

BACKGROUND OF THE INVENTION

1. Field of the Invention

This invention relates to a drawer slide comprising two rails engaging each other, namely a guide rail and a drawer rail, which with an upper rolling web is supported on a track roller in the front end portion of the guide rail, and in the rear end portion carries a track roller rolling between an upper and a lower guiding web of the guide rail, the drawer slide further comprises a lifting protection consisting of a marginal web of the one rail and a supporting stop of the other rail, which cooperate with each other.

2. Description of the Prior Art

The drawer rail of usual drawer slides of this type, which is disposed on the bottom of the drawer, is supported with an upper rolling web on a track roller disposed in the front end portion of the guide rail, and a track roller provided at its rear end engages between two guiding webs of the guide rail, so that the drawer is supported on the front track roller, and in the area of the rear end of the drawer the same is supported by the track roller of the drawer rail either on the lower or on the upper guiding web of the guide rail, depending on the direction of the tilting moment of the drawer about the front track roller of the guide rail, which depends on the pull-out length of the drawer. The track roller guided between the two guiding webs of the guide rail, however, cannot prevent the rolling web from being lifted off the front track roller of the guide rail about the rear track roller of the drawer rail acting as axis of rotation. To obtain a lifting protection for the drawer, it is known (AT 000 648 U1) that tabs protruding against the guide rail are provided as supporting stops on the drawer rail below the upper guiding web of the guide rail. In the case of an attempt at lifting the drawer, these tabs strike against the marginal web of the guiding web and thus prevent the drawer from being lifted off. A disadvantage of this known construction is, however, that when drawing out the drawer, the supporting stops provided on the drawer rail must be moved past the front track roller of the guide rail, which either considerably limits the admissible engagement of the supporting stop over the marginal web, or involves the risk that the supporting stop is urged against the track roller of the guide rail, so that on the one hand the lifting protection of the drawer and on the other hand the functional reliability of the drawer slide are at risk.

SUMMARY OF THE INVENTION

It is, therefore, the object of the invention to develop a drawer slide as described above with a simple construction such that an unrestricted lifting protection can be ensured independent of the functional reliability of the drawer slide.

This object is accomplished by the invention in that the marginal web consists of a bent edge portion of the upper rolling web of the drawer rail, and that the supporting stop preferably provided at the track roller of the guide rail is disposed on the connecting web between the two guiding webs, and protrudes beyond the upper guiding web and overlaps the bent marginal web of the drawer rail.

Since, as a result of this measure, the supporting stop is associated with the guide rail, it is no longer necessary to move this supporting stop past one of the track rollers when drawing out the drawer. By providing a bent edge portion of the upper rolling web of the drawer rail to form a marginal web cooperating with the supporting stop, which overlaps the marginal web on the outside facing away from the track of the track roller, the length of engagement of the supporting stop over the marginal web may be chosen freely and be adapted to the respective requirements. The fact that this construction requires a supporting stop upwardly protruding beyond the connecting web between the two guiding webs hardly increases the constructional effort because the supporting stop may advantageously consist of a bent-up tongue cut out from the upper guiding web. Such integral mounting of the supporting stop on the guide rail is, of course, not absolutely necessary. A separately manufactured supporting stop, which is fixed to the guide rail, performs the same function of safety. When the supporting stop is provided directly at the track roller of the guide rail, there is, on the one hand, ensured a lifting protection over the full pull-out length for fully extractable drawers, and, on the other hand, the lifting angle within the inevitable clearance remains small as a result of the tilting radius depending on the distance between the rear track roller of the drawer rail and the supporting stop.

For introducing the drawer rail, which is fixed to the drawer bottom, into the guide rail, the rear track roller of the drawer rail must first be introduced over the front track roller of the guide rail between the guiding webs thereof, which is easily possible by means of a correspondingly recessed upper guiding web of the guide rail. This introduction of the drawer rail into the guide rail by tilting the drawer upwards, however, leads to the fact that the bent marginal web of the drawer rail is placed on the supporting stop of the guide rail. To ensure that during the insertion of the drawer the supporting stop can overlap the bent marginal web of the drawer rail, the rear end portion of the bent marginal web of the drawer rail, at a distance from the track roller, may be provided with a marginal recess for the supporting stop extending therethrough, so that after the introduction of the rear track roller of the drawer rail between the guiding webs of the guide rail, the supporting stop gets into the area of the marginal recess of the bent edge portion and through this marginal recess into the required position of engagement, in which the lifting protection becomes effective over the full pull-out length, possibly with the exception of the area of the marginal recess. Adjacent the marginal recess for the passage of the supporting stop on the side directed towards the rear end portion of the drawer rail, the marginal web may have a bent-up longitudinal portion to assist the passage of the supporting stop through the marginal recess of the marginal web. Because of the resulting vertical offset, the safety stop cannot be moved past the marginal recess, whose length may be adjusted to the safety stop. Particularly simple constructional conditions are obtained in this connection when the bent-up longitudinal portion forms a pull-out stop for the drawer rail cooperating with the supporting stop, so that separate pull-out stops become superfluous.

BRIEF DESCRIPTION OF THE DRAWING

In the drawing, the drawer slide of the invention is illustrated by way of example.

DETAILED DESCRIPTION OF THE PREFERRED EMBODIMENT

Figure 1:
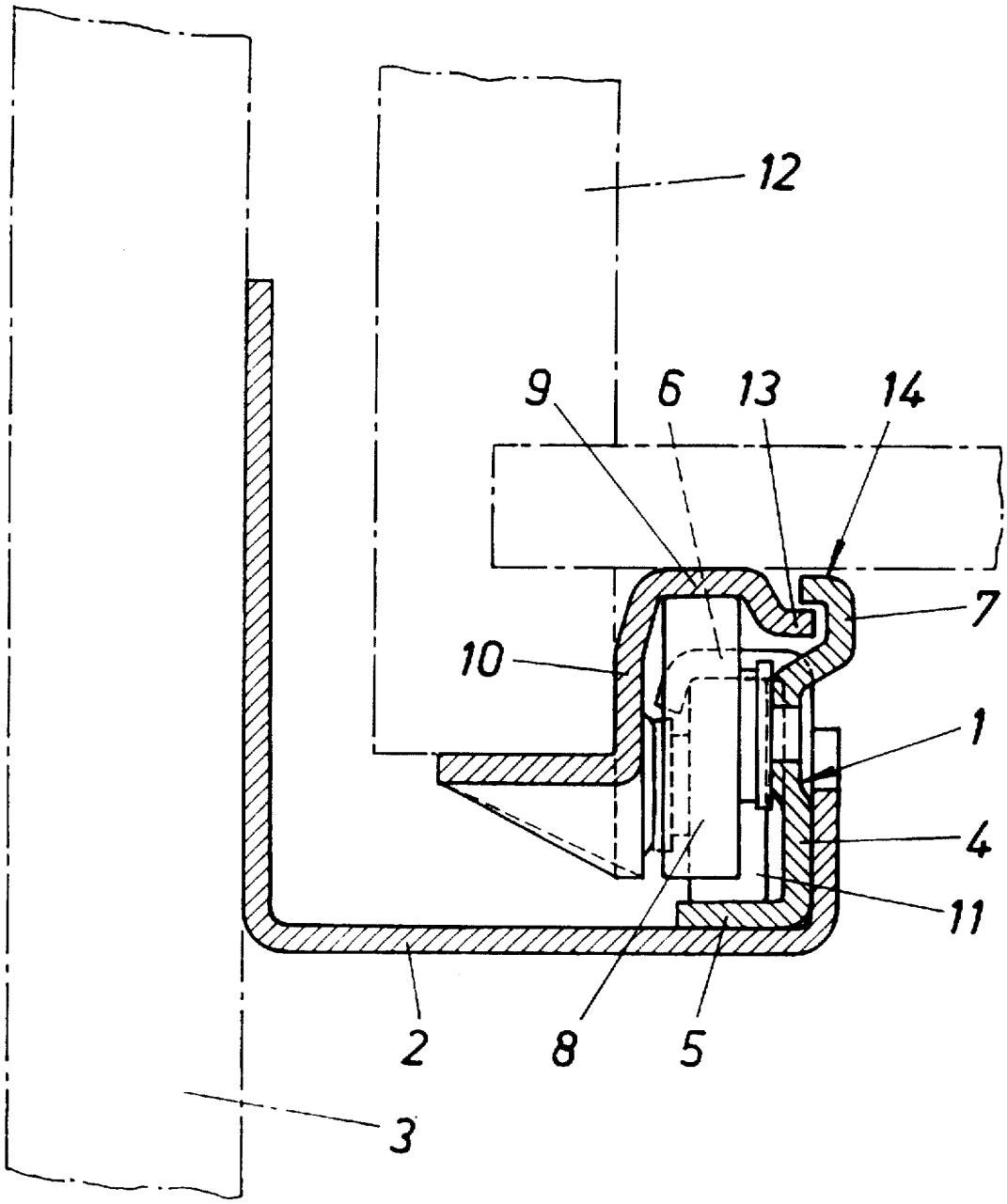
FIG. 1 shows the drawer slide in a schematic cross section at the front track roller of the guide rail.

The illustrated drawer slide comprises a guide rail 1 substantially forming a C-section and supported by fastening straps 2 screwed to a furniture wall 3. The free legs of guide rail 1 are connected by web 4 and form a lower and an upper guiding web 5 and 6, respectively. The upper guiding web 6 defines a recess 15 at the front end of the guide rail 1 with the exception of a bent-up hook-like tongue 7, where a track roller 8 is mounted in the connecting web 4. The rolling web 9 of a drawer rail 10 is supported on track roller 8 and carries a track roller 11 at its rear end portion which engages between the guiding webs 5 and 6 of the guide rail 1. A drawer 12, whose bottom carries the drawer rail 10, is thus, on the one hand, supported on the front track roller 8 of the guide rail 1 by the rolling web 9 of the drawer rail 10, and, on the other hand, is supported on the lower guiding web 5 of the guide rail 1 by the rear track roller 11 of the drawer rail 10 until the center of gravity of the drawer 12 is moved beyond the track roller 8 of the guide rail 1. The tilting moment of the drawer 12 caused by this movement of the center of gravity is absorbed by the upper guiding web 6 of the guide rail 1, against which guiding web the track roller 11 of the drawer rail 10 is then urged.

To prevent the drawer rail 10 from being lifted off the front track roller 8 of the guide rail 1, a lifting protection is provided which consists of a marginal web 13 formed by a bent edge portion of the rolling web 9 of the drawer rail 10 and a supporting stop 14 overlapping this marginal web 13. The supporting stop is formed by the bent-up hook-like tongue 7 on the connecting web 4 of the guide rail 1. As can be seen in FIG. 1, this supporting stop 14 prevents the rolling web 9 of the drawer rail 10 from being lifted off the track roller 8 of the guide rail 1 over the entire pull-out length. The arrangement of the supporting stop 14 at the track roller 8 in addition has the advantage that despite the distance between the supporting stop 14 and the bent marginal web 13, the clearance with respect to an upward movement of the drawer 12 due to a tilting radius defined by the distance between the supporting stop 14 and the rear track roller 11 remains comparatively small.

Figure 3:
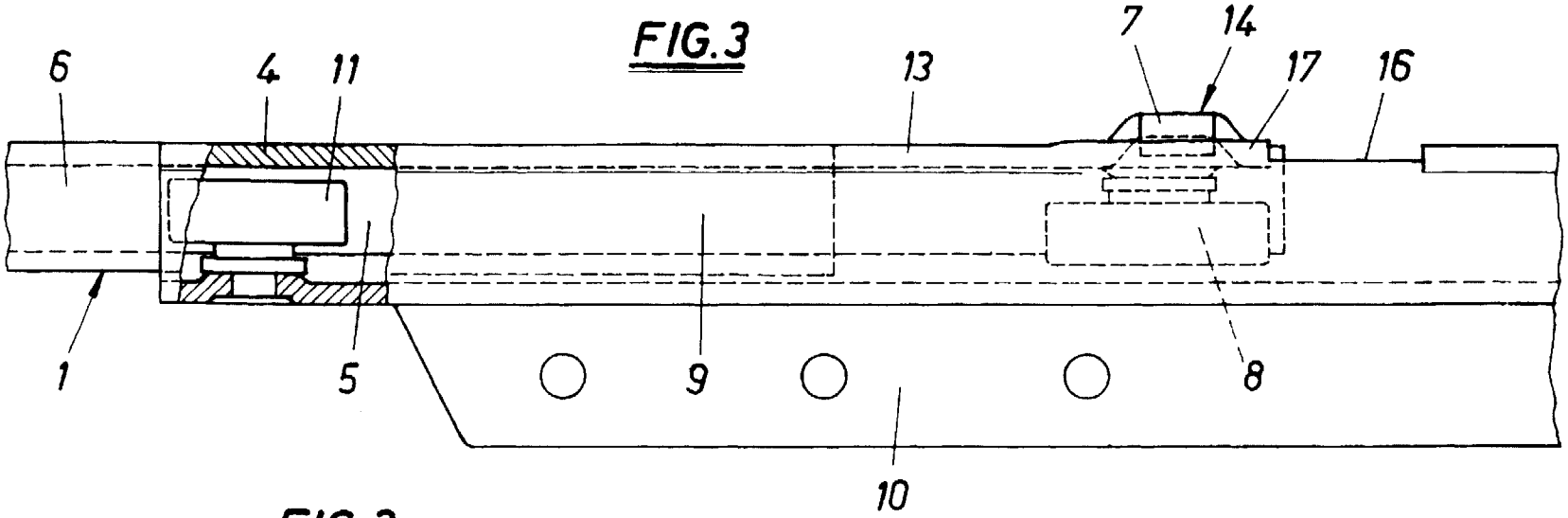
FIG. 3 is a top view of the drawer slide in the intermediate position in accordance with FIG. 2.
Figure 2:
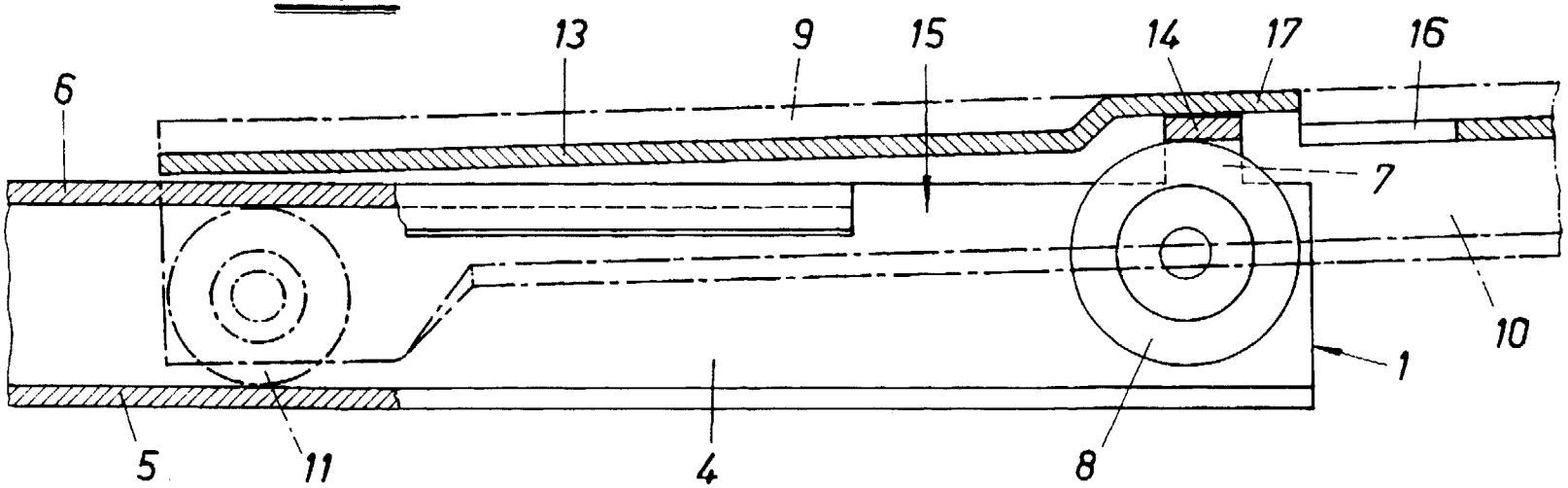
FIG. 2 is a side-elevational view, partly in section, of the drawer slide in accordance with FIG. 1 in an intermediate position during the insertion of the drawer rail into the guide rail.

FIGS. 2 and 3 show an intermediate position in the introduction of the drawer rail 10 into the guide rail 1. The track roller 11 must first of all be introduced between the guiding webs 5 and 6 in the recess 15 of the upper guiding web 6 beyond the track roller 8. This means, however, that the bent marginal web 13 is placed on the supporting stop 14 from above. To ensure that the supporting stop 14 can engage over the bent marginal web 13, the marginal web 13 is provided with a marginal recess 16 at a distance before the track roller 11, through which recess the supporting stop 14 can extend over the upper side of the marginal web 13, when the drawer rail 10 is lowered. During the further longitudinal movement of the drawer rail 10, whose rolling web 9 then rests on the track roller 8 of the guide rail 1, the supporting stop 14 is guided above the marginal web 13 as shown in FIG. 1.

To assist the passage of the supporting stop 14 through the marginal recess 16, the bent marginal web 13 of the drawer rail 10 is upwardly bent adjacent the rear end of the marginal recess 16 in a longitudinal portion 17, as can be seen in particular in FIG. 2. When introducing the drawer rail 10 into the guide rail 1, the supporting stop 14 thus engages the bent-up longitudinal portion 17 and is moved into the marginal recess 16 open towards this longitudinal portion 17. Since as a result of the vertical offset a further movement of the drawer rail 10 is prevented without the supporting stop 14 extending through the marginal recess 16, the locking position of the supporting stop 14 is ensured during the insertion of the drawer rail 10 into the guide rail 1. When drawing out the inserted drawer rail 10, the safety stop 14 will strike against the bent-up longitudinal portion 17 of the marginal web 13, which may advantageously be utilized as a pull-out stop.

Although the invention has been illustrated with reference to a simple drawer, it is not restricted to such embodiment and might also be used with a fully extendable drawer, where, for instance, the drawer rail 10 may be prolonged by a rear, pivotally mounted supporting lever when drawing out the drawer 12.

I claim:

1. A drawer slide comprising a guide rail and a drawer rail, the rails engaging in each other, the guide rail having an upper guiding web, a lower guiding web and a web connecting the upper and lower guiding webs, the drawer rail having an upper rolling web comprising a main horizontal web under the weight of gravity on a first track roller in a front end portion of the guide rail and the drawer rail carrying a second track roller in a rear end portion thereof, the second track roller rolling between the upper guiding web and the lower guiding web of the guide rail, and a device for preventing the drawer rail from being lifted off the guide rail, said device comprising a marginal web consisting of a bent edge portion of the upper rolling web of the drawer rail, and a supporting stop disposed on the connecting web of the guide rail and overlapping the marginal web whereby the supporting stop is adapted to be engaged by the marginal web, wherein said support stop prevents lifting the drawer rail.

2. The drawer slide of claim 1, wherein the supporting stop is located adjacent the first track roller.

3. The drawer slide of claim 2, wherein the upper guiding web defines a recess accommodating the first track roller, and the supporting stop consists of a bent-up tongue cut out from the upper guiding web in said recess.

4. The drawer slide of claim 3, wherein the marginal web defines a recess enabling the supporting stop to pass through the marginal web.

5. The drawer slide of claim 4, wherein the marginal web forms a bent-up longitudinal portion extending from the recess defined in the marginal web toward the rear end portion of the drawer rail, the bent-up longitudinal portion being adapted to receive the supporting stop.

* * * * *